US006565305B2

(12) United States Patent
Schrafel

(10) Patent No.: US 6,565,305 B2
(45) Date of Patent: May 20, 2003

(54) CONTAINER HANDLER MOUNTING MECHANISM

(75) Inventor: Tracy L. Schrafel, West Concord, MN (US)

(73) Assignee: McNeilus Truck and Manufacturing, Inc., Dodge Center, MN (US)

( * ) Notice: Subject to any disclaimer, the term of this patent is extended or adjusted under 35 U.S.C. 154(b) by 0 days.

(21) Appl. No.: 09/955,689

(22) Filed: Sep. 19, 2001

(65) Prior Publication Data

US 2003/0053895 A1 Mar. 20, 2003

(51) Int. Cl.[7] ..... B65F 3/02
(52) U.S. Cl. ..... 414/408; 414/421
(58) Field of Search ..... 414/406, 407, 414/408, 409, 421, 419, 422, 546, 558

(56) References Cited

U.S. PATENT DOCUMENTS

| | | | | |
|---|---|---|---|---|
| 3,458,071 A | * | 7/1969 | Smith | 414/408 |
| 4,065,008 A | | 12/1977 | Ratledge | |
| 4,461,608 A | | 7/1984 | Boda | |
| 4,773,812 A | | 9/1988 | Bayne et al. | |
| 4,960,355 A | * | 10/1990 | Worthington | 414/408 |
| 5,024,573 A | * | 6/1991 | Redding et al. | 414/408 |
| 5,478,188 A | | 12/1995 | Rea et al. | |
| 5,651,654 A | * | 7/1997 | Christenson | 414/408 |
| 5,762,462 A | | 6/1998 | Bayne | |
| 5,772,385 A | | 6/1998 | Huntoon et al. | |
| 5,826,485 A | | 10/1998 | Bayne et al. | |
| 6,123,497 A | | 9/2000 | Duell et al. | |

OTHER PUBLICATIONS

US2002/0141854 A1 (Oct. 3, 2002)—Provisional application of Arrez (filed Mar. 30, 2001)—copy in 414/408.*
US 2002/0119034 A1 (Aug. 29, 2002)—Arrez—copy in 414/408, (filed Feb. 22, 2002).*

* cited by examiner

*Primary Examiner*—James W. Keenan
(74) *Attorney, Agent, or Firm*—Nikolai & Mersereau, P.A.; C. G. Mersereau

(57) ABSTRACT

A mounting system for mounting a container handling device on a refuse gathering vehicle accomplishes the mounting in a manner which enables translation of the device between deployed and stowed positions so that the container handling device is protected and out of the way when not in use.

6 Claims, 5 Drawing Sheets

CONTAINER HANDLER MOUNTING MECHANISM

BACKGROUND OF THE INVENTION

I. Field of the Invention

The present invention concerns refuse collection vehicle auxiliary mechanisms generally and particularly relates to container handling devices, particularly cart tipping or lift and dump mechanisms attached to rear loading, rear discharge refuse vehicles. The invention specifically pertains to a mounting mechanism that enables a cart tipping mechanism to translate slideably between an operating position upright on the tailgate to a retracted or stowed position beneath the tailgate where it does not protrude from the rear of the vehicle thereby reducing the possibility of damage or interference with other operations when not in use.

II. Related Art

The conventional and traditional galvanized trash cans of old which were emptied by hand into rear loading refuse packing vehicles have largely been replaced by locally standardized wheeled cart type containers made of synthetic materials and which have a hinged lid and integral tipping bar to permit manipulation for lifting and dumping. The containers are designed to be wheeled on two wheels and to be addressed by compatible cart tipping mechanisms for lifting and inverting or tipping. The tipping bar is typically positioned to be hooked by a fixed element of the cart tipping mechanism which is thereafter operated to lift, dump and return the cart to an upright position at the end of the receptacle dumping cycle. The cart may thereafter be wheeled back to its position on the curb.

These lift and tip or dumping mechanisms are typically with rear loaded refuse vehicles and are commonly fixed to the rear of the refuse collection vehicle from which they protrude an amount beyond the rear bumper of the vehicle. Since it is difficult or not possible for the driver of the vehicle to see the rear cart tipper, the cart tipper is vulnerable and susceptible to being damaged should the truck strike an obstacle while backing up or be itself struck from the rear. In addition, the location of the cart tipper may interfere with the operation of other devices such as winch mechanisms used to lift and dump larger receptacles. In addition, the mounting of the lifter or tipper apparatus to the tailgate of the rear loading refuse vehicle normally involves cutting into existing tailgate structural members to form a recess or insert opening necessary to mount the device. This, of course, may affect the strength and integrity of the tailgate structure.

It can readily be seen that such a collection system would be benefited a great deal if the cart tipping mechanism could somehow be mounted in a manner which did not interfere with the structure of the tailgate and which enabled the cart tipping mechanism to be stored in a non-interfering storage position when not in use.

Accordingly, it is a primary object of the present invention to provide an improved mounting system for a rear mounted receptacle lift and tipping mechanism that allows the mechanism to translate to a non-interfering position when not in use.

Another object of the present invention is to provide such a mounting system that does not require compromising the structural integrity of the tailgate to which it is attached.

Yet another object of the present invention is to provide a mounting for a lifting and tipping or dumping mechanism that is mechanically uncomplicated yet allows easy transition between storage and working positions.

Other objects and advantages of the invention will become apparent to those skilled in the art upon familiarization with the contents of this specification.

SUMMARY OF THE INVENTION

In accordance with the present invention many of the problems associated with mounting a container handling device of a class including receptacle lift and dump or tipping devices for small carts are solved by the provision of a mounting system for mounting such a container handling device on a refuse gathering vehicle which enables translation of the device between deployed and stowed positions by slideably moving the device between a fully operational position beyond the rear of the tailgate to a stowed position beneath the tailgate in which the container handling device is not exposed beyond the confines of the tailgate.

One embodiment of the mounting system of the invention includes a pair of opposed spaced parallel structural shapes typically steel plates, each containing a pair of elongated shaped support members having openings therein in the form of cutouts or slot openings, the support members being intended to be fixed to the refuse vehicle where the container handling device is to mounted. A generally flat mounting base member or plate for carrying the container handling device itself is provided. The mounting base member is provided with a pair of opposed spaced parallel shaped members fixed to and extending away from it, each having a pair of spaced follower members, each follower member disposed so as to mount and ride in a corresponding one of the slots in one of the structural support members. The mounting base member is carried by the structural support members in a manner such that the translation of the follower members along the slots positions the mounting member and a container handling device fixed to the mounting member between a stowed in a fully deployed position. A pivotally mounted linearly operating prime mover preferably in the form of a hydraulic cylinder is connected between the mounting member and a mount carried by additional strut members fixed to the refuse gathering vehicle to position the mounting member between the stowed and deployed positions. The stationary mount of the container handling device is fixed as by bolting or welding to the mounting member rather than the tailgate structure. The container handling device itself may be any of several commercially available units.

DESCRIPTION OF THE DRAWINGS

In the drawings wherein like numerals depict like parts throughout the same.

DETAILED DESCRIPTION

It will be noted that the detailed embodiments of the mechanized cart tipper mounting system of the invention are directed to a rear loading refuse gathering vehicle, this is done without intent to limit the scope of the invention concept in any manner and it will be appreciated that such a mounting system may find use elsewhere and with reference to other mechanisms. With this in mind, the description follows.

Figure 1:
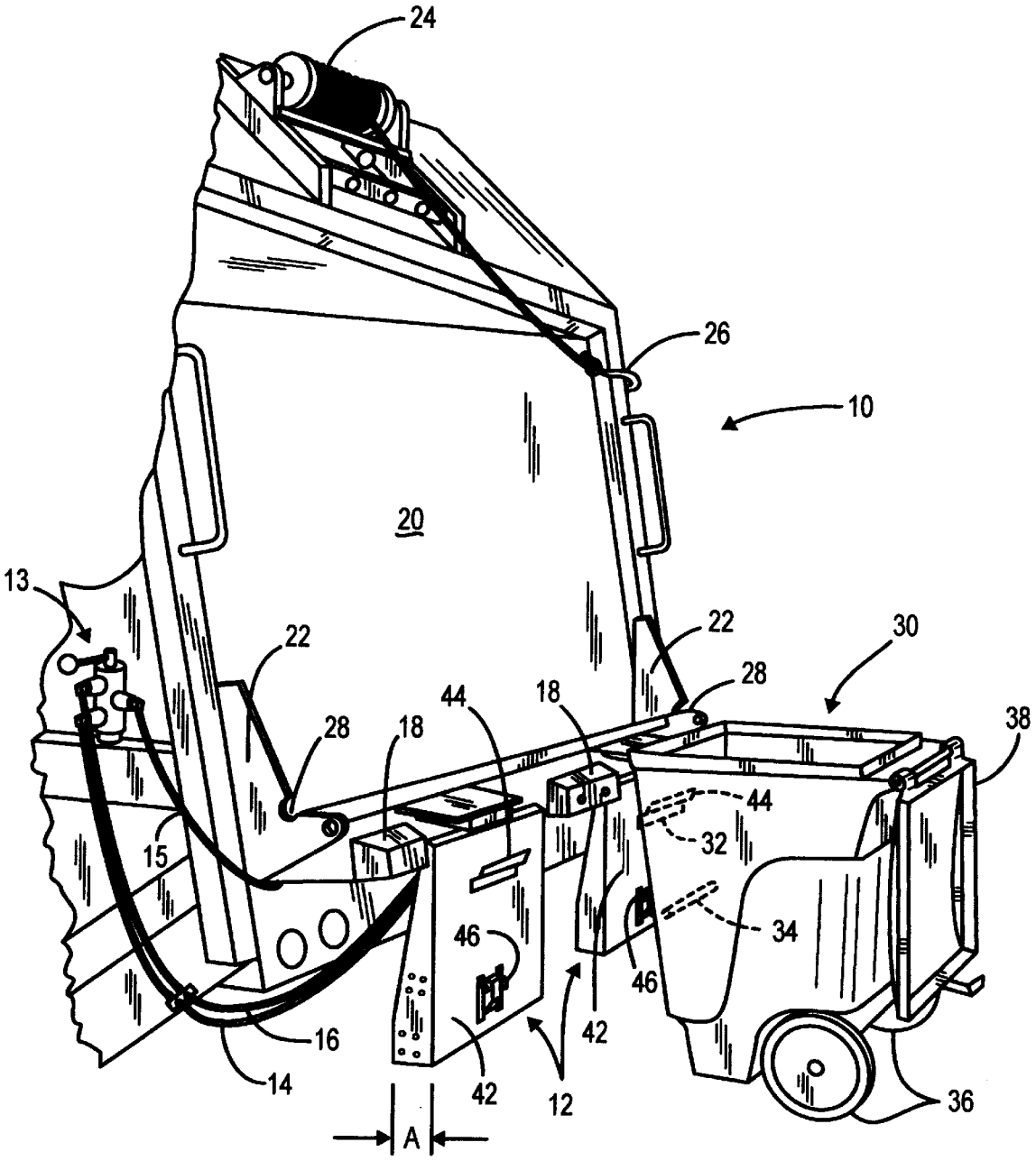
FIG. 1 ( PRIOR ART )
FIG. 1 depicts a fragmentary perspective view of a rear loading refuse vehicle depicting two cart tipping devices mounted in accordance with the prior art.

FIG. 1 illustrates a rear loading refuse vehicle including two cart tipping devices mounted in accordance with the prior art. The rear of the vehicle is shown generally at 10 including a pair of mechanized cart lifting and tipping devices 12 which are typically operated by hydraulic rotary motor (not shown) controlled by a manual hydraulic valve system 13 through a pair of hydraulic lines 14 and 16. The valve may be supplied with hydraulic fluid via line 15 in a manner well known to those skilled in the art of operating such devices. Bumper devices are shown at 18 and a refuse receiving opening in the rear of the tailgate exists in the opening 20. It should be noted that the truck body 10 may also include conventional pivot elements 22 and a winch mechanism 24. The winch mechanism in 24 normally includes a hook 26 mounted at the end of a cable which is used to raise commercial trash dumpsters about the pivot points shown at 28 of pivot elements 22 thereby enabling a commercial dumpster to be dumped into opening 20 of the truck 10.

Much of the loading of the truck body 10 is done by lifting and tipping hand wheeled carts such as that shown at 30 which include an upper engaging element 32 and a lower engaging element 24. A pair of wheels is shown at 36 and a pivoting cover or lid at 38. Each lifting and tipping mechanism 12 is provided with a movable carriage 42 which is capable of lifting and pivoting to accomplish container emptying, and which further includes a fixed upper engaging element 44 and a movable lower engaging element 46. These are designed to engage and tip the cart 30 utilizing engaging elements 32 and 34. Once the receptacle 30 is wheeled into position with its lid open, it may be tilted back on its wheels 36 and be guided into contact with the surface of movable carriage 42 so that fixed engagement element 44 positively engages the element 32. Once lifting and dumping is accomplished, the cart can again be tilted back and wheeled to its original position at the curb or other location designated for pickup.

Figure 2:
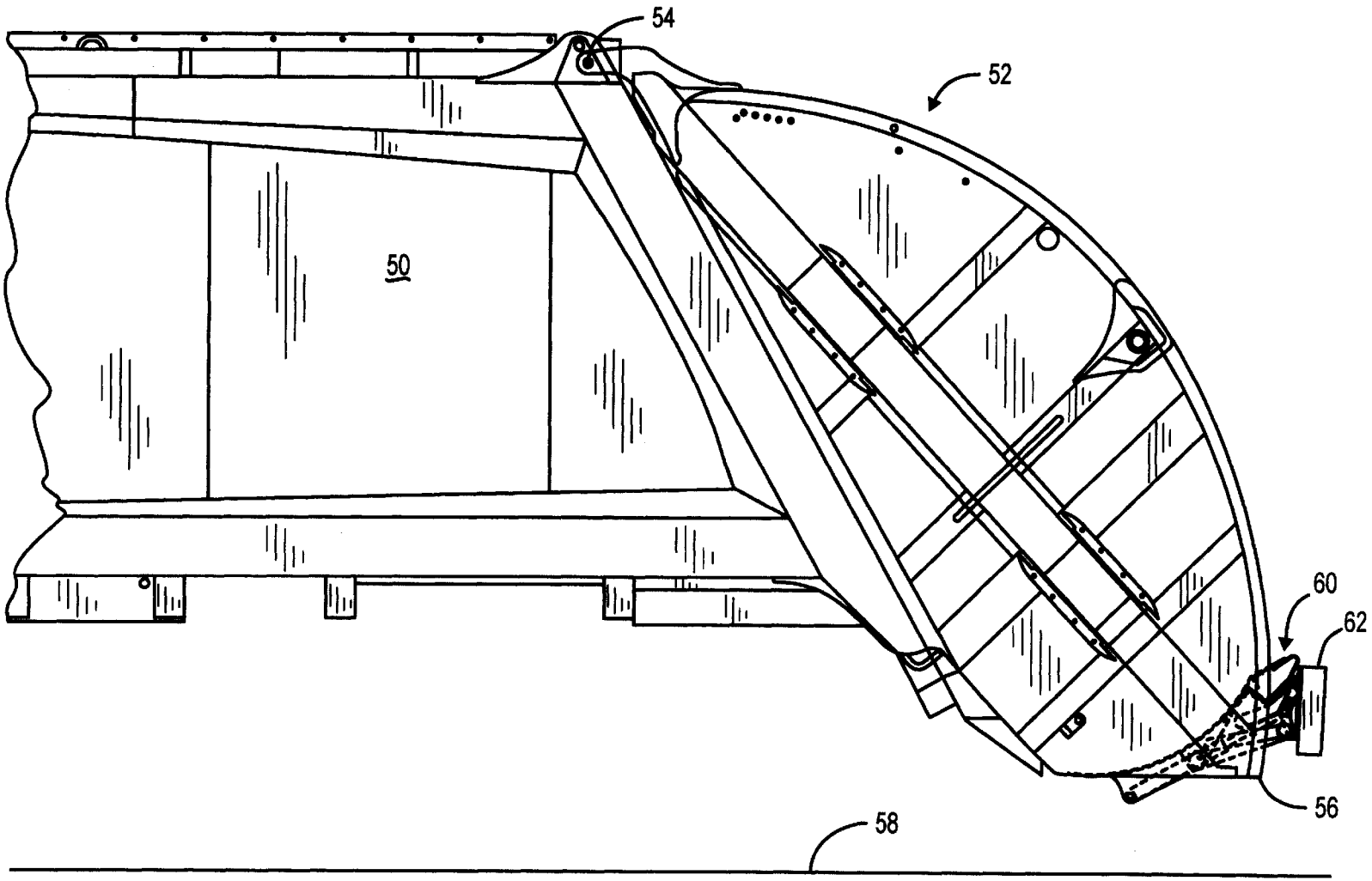
FIG. 2 is a fragmentary side view of a rear loading refuse vehicle depicting the mounting system of the invention in the extended or operational position.

FIG. 2 is a fragmentary side view of a rear loading refuse vehicle depicting the mounting system of the invention in the extended position with the tipping mechanism deployed and includes a truck container storage body 50 with rear loading/compacting tailgate 52 hinged for opening for ejection at 54 in a conventional manner. The normal rear bottom extremity of the tailgate is shown at 56 and ground level depicted by 58. The container lift and tipping mechanism mounting system is shown generally by 60 and the container tipping mechanism itself is depicted in the fully extended upright or operating position at 62. The container lift tipping mechanism illustrated at 62 maybe similar to that shown in FIG. 1 and such devices are commercially available as from, for example, the Bayne Machine Works, Inc., of Simpsonville, S.C. The lift and tipping mechanism 62 is, then, a self-contained auxiliary unit to which hydraulic fluid and electrical control power are supplied in a well-known manner. The present invention deals with the mounting and translation of such as self-contained unit and not the lifting and tipping mechanism itself.

Figure 3:
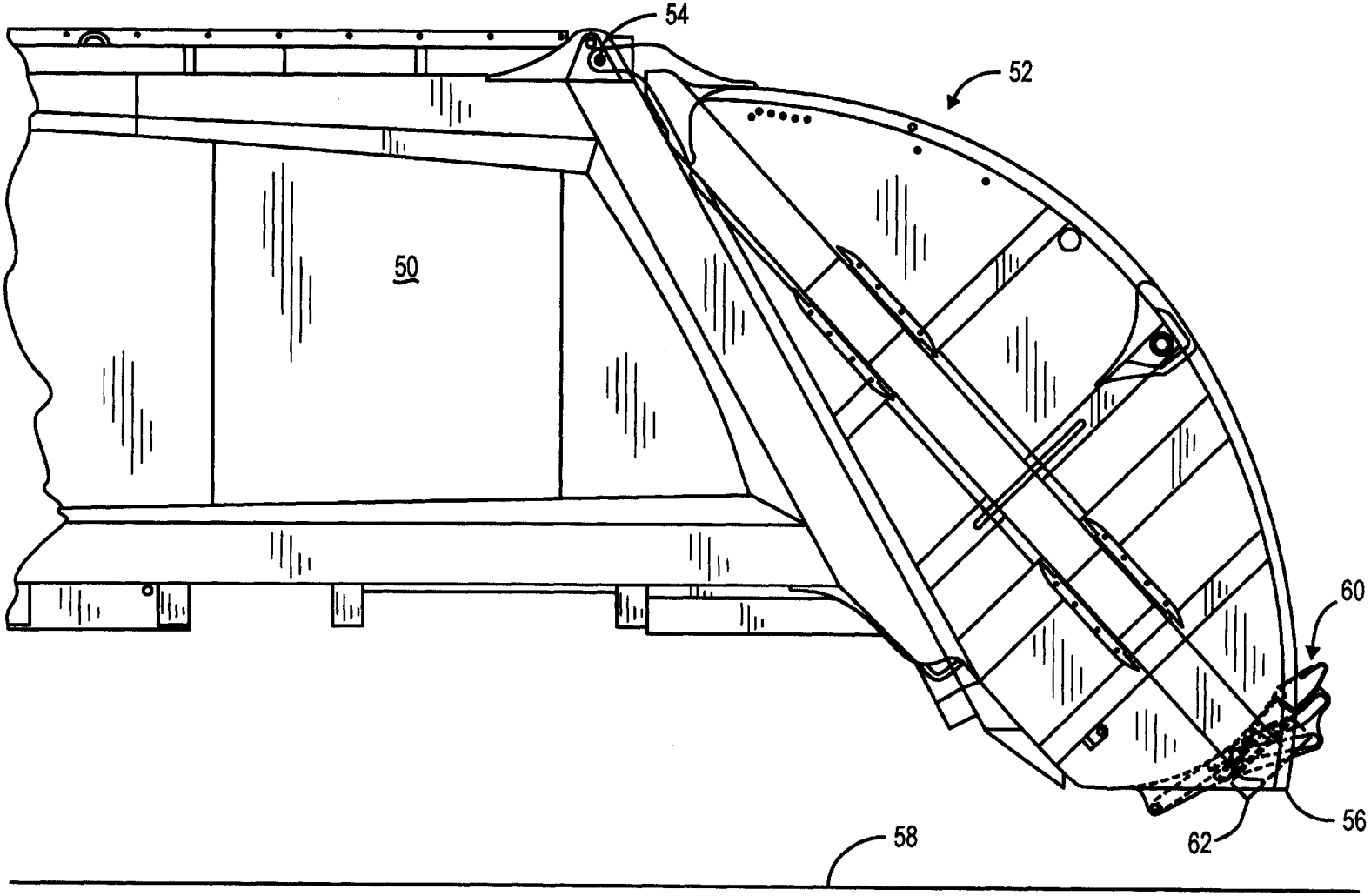
FIG. 3 is a view to similar to that of FIG. 2 showing the mounting system of the invention and the retracted or stowed position.

FIG. 3 is similar to FIG. 2 except that the mechanism 62 has translated to a stowed position beneath the tailgate 52 as operated by hydraulic cylinder 64. Note that in both cases the mechanism also adequately clears the ground in the stowed position. It will be noted that with the lifting and tipping mechanism 62 in the stowed position, the support system protrudes very little if any beyond existing portions of the tailgate.

Figure 4:
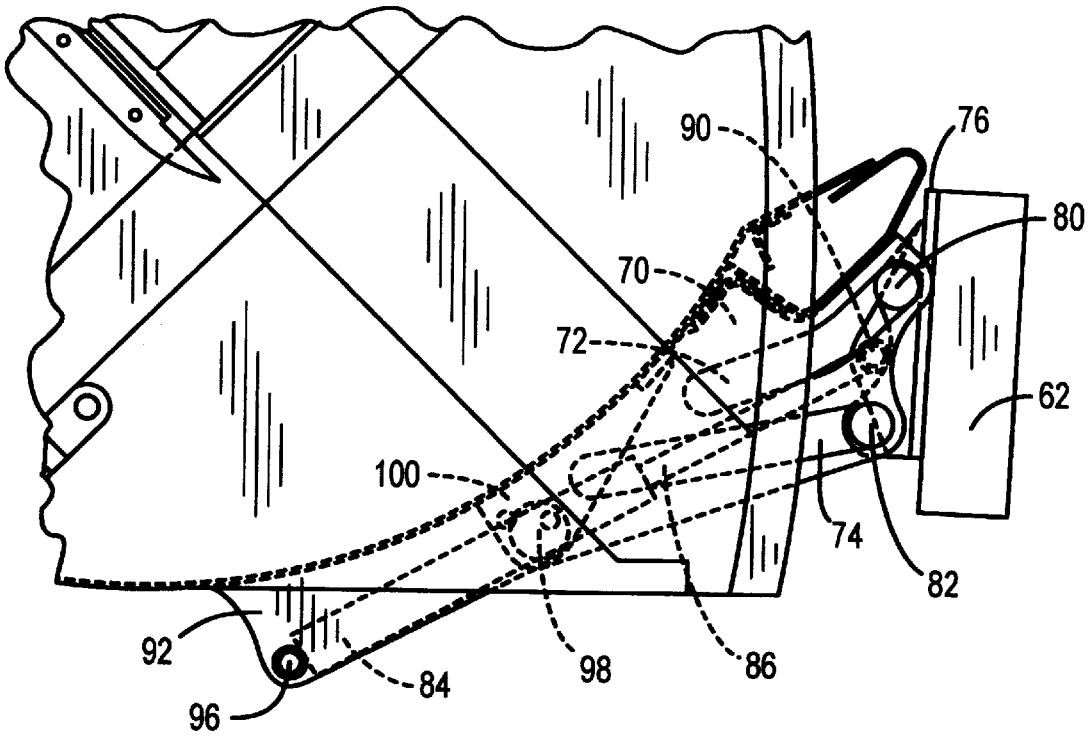
FIGS. 4 and 5 are greatly enlarged fragmentary views showing the mounting system depicted respectively in FIGS. 2 and 3.
Figure 5:
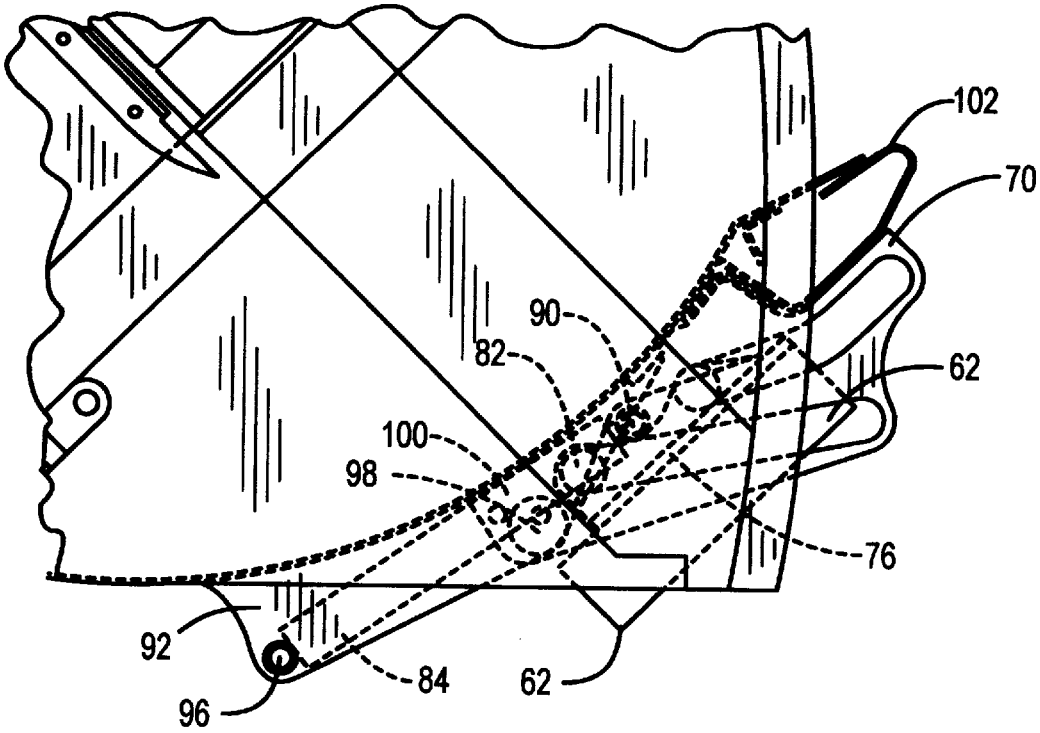
Figure 6:
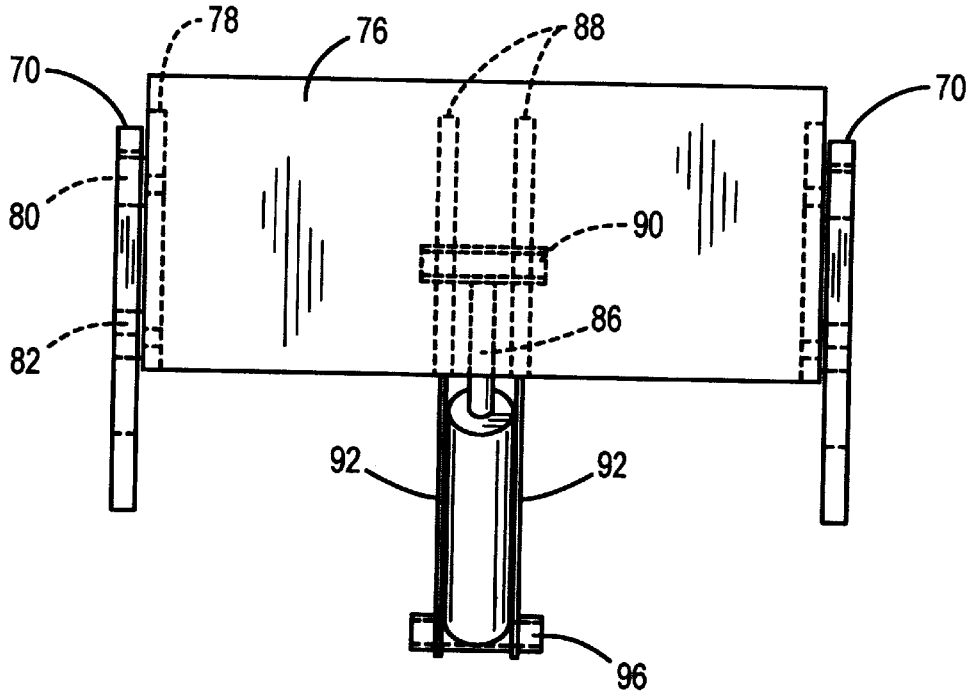
FIG. 6 is a rear view of the mounting mechanism of FIGS. 2 and 4 with the tipper mechanism removed.
Figure 7:
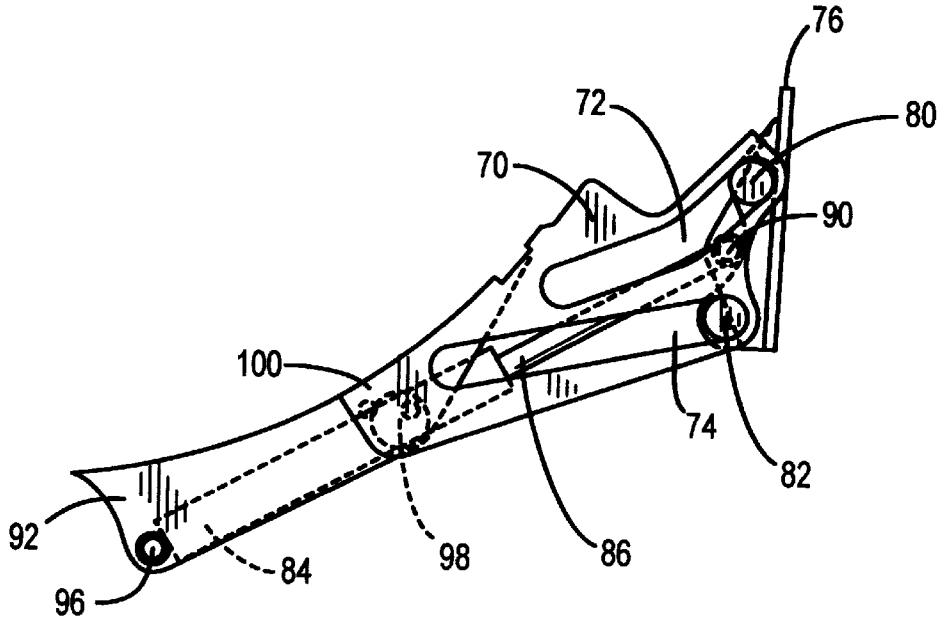
FIG. 7 is a side view of the mechanism of FIG. 6.

Details of the mechanism of the invention may best be seen in the enlarged views of FIGS. 4–7. As can be seen in FIGS. 6 and 7, the mechanism includes a pair of identically shaped opposed support members 70 each of which is fixed in a recess provided in the tailgate structure and is further provided with a pair of slots 72 and 74. The pair of spaced members 70 are designed to carry a baseplate or mounting base member 76 which, in turn, is fixed to the support frame or stationary portion of a cart lifting and tipping mechanism which is normally also a planar member in the form of a steel plate. The mounting base member 76 is provided with flanking spaced opposed shaped plate members 78 each of which is provided with a pair of protruding spaced follower members 80 and 82 which when the mechanism is assembled mount and ride in a respective slot 72 and 74 in the support member 70, moving therealong during the translation of the system.

The system is operated by a hydraulic cylinder 84 having an extensible rod 86 which is mounted in rotatable fashion between a pair of brackets 88 on the member 76 which is carries a journalled shaft 90 to which the rod 86 is attached in conventional fashion. The blind end of the cylinder 84 is attached between a pair of structural plate members 92 fixed to the underside of the tailgate structure at 94 in pivoting fashion using a rotating pin member 96. The structural member 72 is further fixed to the tailgate using cross-members 98 and gusset members 100 which also flank the cylinder 84.

As can be seen particularly from FIGS. 3 and 5 when the mechanism 62 is in the stowed position the support members 70 are even with the tailgate structure at 102 and the mechanism is clearly protected. This is in contrast to the exposure of the mechanism 62 in the upright and operational configuration as shown in FIGS. 2 and 4. In addition, the integrity of the tailgate structure itself remains intact.

In operation, the fluid cylinder 84, which is preferably a hydraulic cylinder, is normally in the retracted or collapsed position as shown in FIG. 5 with the rod 86 fully withdrawn and the lift and tilt mechanism 62 in the stowed position. Upon extension of the rod 86 of cylinder 84, the system slideably moves and assumes the position in FIG. 4 with the lift and tilt mechanism in the fully extended upright position for processing containers when the rod 86 of cylinder 84 is fully extended. The pairs of follower members 80 and 82, of course, at the same time traverse the respective slots 72 and 74 during deployment of the lift and tilt mechanism 62.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. In a rear-loading refuse vehicle including a refuse storage body, a rear-loading and compacting tailgate extending behind said storage body and top-hinged thereto for opening for ejection of contained material, a mounting system, including a mounting base for carrying a container handling device, fixed to the lower portion of said tailgate in a manner which enables translation of the mounting base between deployed and stowed positions, said mounting system comprising:

(a) a pair of opposed spaced parallel structural support shapes adapted to be fixed to and extend away from said tailgate, each said structural support shape being provided with a pair of elongated shaped slot openings each having a first and a second end;

(b) said mounting base including a generally flat mounting base member for carrying the container handling device and having fixed thereto a pair of opposed spaced parallel shaped members each carrying a pair of spaced follower members each follower member being disposed to mount and ride in a corresponding one of said slot openings, wherein the translation of said follower members along said slot opening between said first and second ends positions said mounting base member such that the container handling device fixed thereto translates between a stowed position at said first end and a deployed position at said second end; and (c) a pivotally mounted, linearly operating prime mover connected between said tailgate and said base member to position said mounting base member between said stowed and said deployed positions.

2. A mounting system as in claim 1 wherein said prime mover is a hydraulic cylinder having a rod end and a blind end and being pivotally connected between said mounting base member and said tailgate.

3. A mounting system as in claim 2 wherein said mounting base member is provided with spaced parallel mounting brackets carrying a shaft to which the said rod end of said hydraulic cylinder is pivotally attached.

4. A mounting system as in claim 3 further comprising a pair of spaced parallel structural members connected to said tailgate of said refuse vehicle and which carry a shaft on which the said blind end of said hydraulic cylinder is pivotally connected.

5. A mounting system as in claim 2 further comprising a pair of spaced parallel structural members connected to said tailgate of said refuse vehicle and which carry a shaft on which the said blind end of said hydraulic cylinder is pivotally connected.

6. A mounting system as in claim 1 wherein said mounting base member is a plate member and said container handling device is a lift and tipping mechanism having a stationary portion, said plate member being one to which the stationary portion of said lift and tipping mechanism is fixed.

* * * * *